US007768462B2

(12) United States Patent
Zhang et al.

(10) Patent No.: US 7,768,462 B2
(45) Date of Patent: Aug. 3, 2010

(54) MULTIBAND ANTENNA FOR HANDHELD ELECTRONIC DEVICES

(75) Inventors: Zhijun Zhang, Santa Clara, CA (US); Robert W. Schlub, Campbell, CA (US); Robert J. Hill, Salinas, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 372 days.

(21) Appl. No.: 11/895,053

(22) Filed: Aug. 22, 2007

(65) Prior Publication Data

US 2009/0051604 A1 Feb. 26, 2009

(51) Int. Cl.
*H01Q 1/24* (2006.01)
*H01Q 1/48* (2006.01)

(52) U.S. Cl. ..... 343/702; 343/846

(58) Field of Classification Search ..... 343/702, 343/700 MS, 846, 848, 767
See application file for complete search history.

(56) References Cited

U.S. PATENT DOCUMENTS

| | | | | |
|---|---|---|---|---|
| 6,140,966 | A * | 10/2000 | Pankinaho | 343/700 MS |
| 6,348,894 | B1 * | 2/2002 | Lahti | 343/702 |
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,856,294 | B2 | 2/2005 | Kadambi et al. | |
| 6,980,154 | B2 | 12/2005 | Vance et al. | |
| 7,027,838 | B2 | 4/2006 | Zhou et al. | |
| 7,116,267 | B2 | 10/2006 | Schuster et al. | |
| 7,119,747 | B2 | 10/2006 | Lin et al. | |
| 2003/0107518 | A1 | 6/2003 | Li et al. | |
| 2004/0017318 | A1 | 1/2004 | Annabi et al. | |
| 2004/0058723 | A1 * | 3/2004 | Mikkola et al. | 455/575.7 |
| 2004/0145521 | A1 | 7/2004 | Hebron et al. | |

(Continued)

FOREIGN PATENT DOCUMENTS

EP 1 351 334 A 10/2003

(Continued)

OTHER PUBLICATIONS

Hill et al. U.S. Appl. No. 11/650,187, filed Jan. 4, 2007.

(Continued)

*Primary Examiner*—Hoang V Nguyen
*Assistant Examiner*—Robert Karacsony
(74) *Attorney, Agent, or Firm*—Treyz Law Group; G. Victor Treyz; David C. Kellogg

(57) ABSTRACT

A handheld electronic device is provided that contain wireless communications circuitry. The wireless communications circuitry may include antenna structures. A first antenna may handle first and second communications bands. A second antenna may handle additional communications bands. The first and second antennas may be located at opposite ends of the handheld electronic device. Conductive structures in the handheld electronic device may form an antenna ground plane. The antenna ground plane may have portions defining an antenna slot. An L-shaped antenna resonating element may be located adjacent to the slot. In the first communications band, the L-shaped antenna resonating element may serve as a non-radiating coupling stub that excites the antenna slot. In the second communications band, the L-shaped antenna resonating element may transmit and receive radio-frequency signals.

20 Claims, 15 Drawing Sheets

U.S. PATENT DOCUMENTS

2006/0055606 A1 3/2006 Boyle
2008/0231521 A1 9/2008 Anguera Pros et al.

FOREIGN PATENT DOCUMENTS

EP 1 401 050 A 3/2004
WO 04/001894 A 12/2003
WO 2005/109567 A 11/2005
WO 2006/070017 7/2006

OTHER PUBLICATIONS

Hill et al. U.S. Appl. No. 11/821,192, filed Jun. 21, 2007.

* cited by examiner

MULTIBAND ANTENNA FOR HANDHELD ELECTRONIC DEVICES

BACKGROUND

This invention relates generally to wireless communications circuitry, and more particularly, to wireless communications circuitry for handheld electronic devices.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use long-range wireless communications to communicate with wireless base stations. For example, cellular telephones may communicate using cellular telephone bands at 850 MHz, 900 MHz, 1800 MHz, and 1900 MHz. Handheld electronic devices may also use short-range wireless communications links. For example, handheld electronic devices may communicate using the WiFi® (IEEE 802.11) band at 2.4 GHz and the Bluetooth® band at 2.4 GHz. Communications are also possible in data service bands such as the 3G data communications band at 2170 MHz band (commonly referred to as the UMTS or Universal Mobile Telecommunications System band). Handheld devices with Global Positioning System (GPS) capabilities receive GPS signals at 1575 MHz.

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or may be formed from a sheet of thin metal using a foil stamping process. Antennas such as planar inverted-F antennas (PIFAs) and antennas based on L-shaped resonating elements can be fabricated in this way. Antennas such as PIFA antennas and antennas with L-shaped resonating elements can be used in handheld devices.

Although modern handheld electronic devices often need to function over a number of different communications bands, it is difficult to design a compact antenna that covers all frequency bands of interest.

It would therefore be desirable to be able to provide improved antennas and wireless handheld electronic devices.

SUMMARY

Handheld electronic devices and antennas for handheld electronic devices are provided. A handheld electronic device may have conductive structures that form an antenna ground plane element. The ground plane element may have portions that define an antenna slot. An antenna resonating element such as an L-shaped antenna resonating element may be located adjacent to the slot. The ground plane element with its slot and the L-shaped antenna resonating element may be used to form a hybrid antenna for the handheld electronic device. The hybrid antenna may be used to cover multiple frequency bands of interest. For example, the hybrid antenna may be used to cover a first communications band at 1575 MHz (Global Positioning System signals) and a second communications band at 2.4 GHz. An additional antenna (e.g., for data and cellular communications) may be located at the opposite end of the handheld electronic device.

The L-shaped antenna resonating element may be near-field coupled to the antenna slot. In the first communications band, the L-shaped antenna resonating element may serve as a non-radiating coupling stub that excites the antenna slot. The antenna resonance provided by the antenna slot portion of the hybrid antenna may be used to receive signals in the first communications band. In the second communications band, the L-shaped antenna resonating element may act as a monopole antenna that is used to transmit and receive radio-frequency signals.

Further features of the invention, its nature and various advantages will be more apparent from the accompanying drawings and the following detailed description of the preferred embodiments.

DETAILED DESCRIPTION

The present invention relates generally to wireless communications, and more particularly, to wireless electronic devices and antennas for wireless electronic devices.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, which is sometimes described herein as an example, the portable electronic devices are handheld electronic devices.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
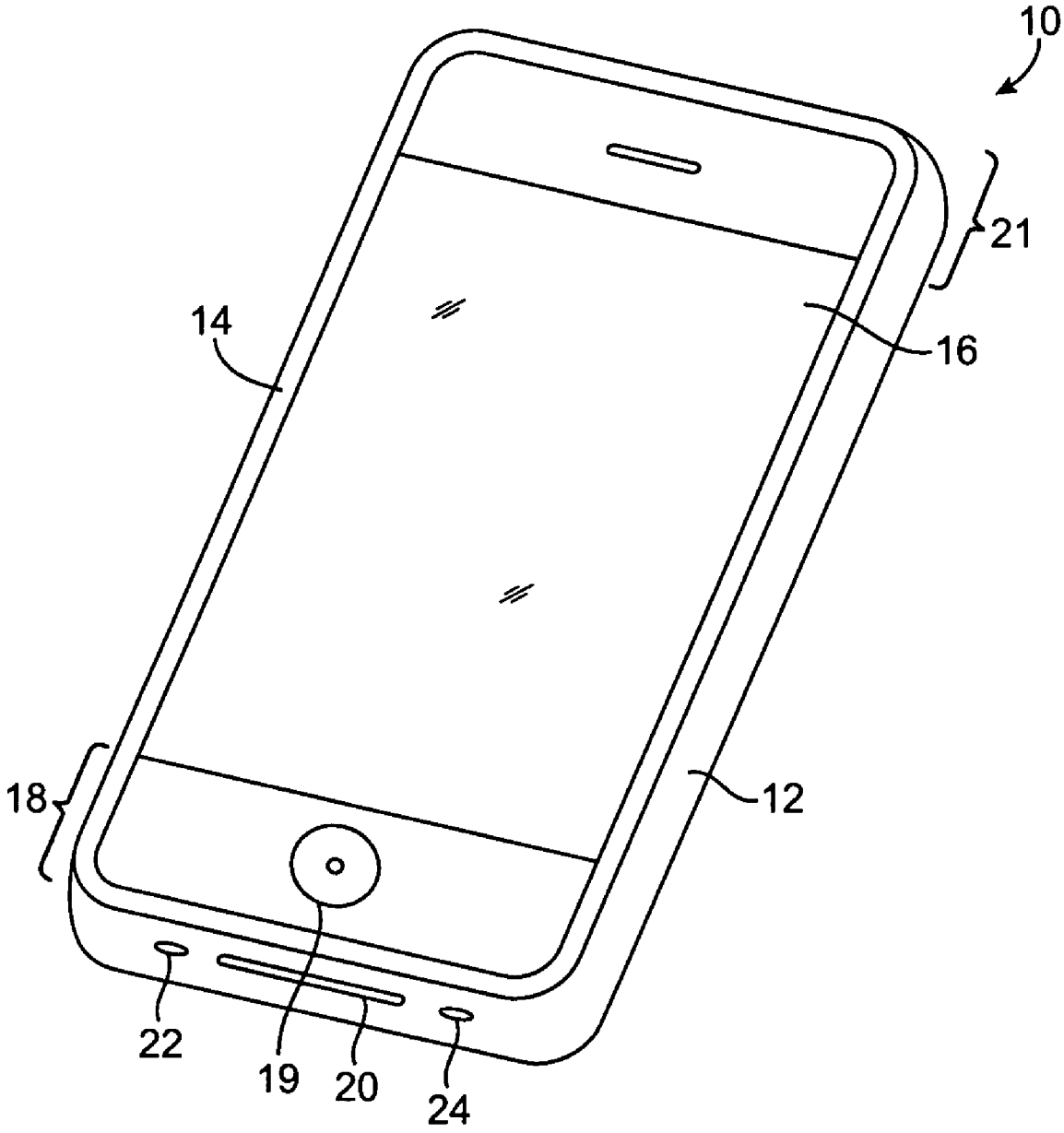
FIG. 1 is a perspective view of an illustrative handheld electronic device with antenna structures in accordance with an embodiment of the present invention.

An illustrative handheld electronic device in accordance with an embodiment of the present invention is shown in FIG. 1. Device 10 may be any suitable portable or handheld electronic device.

Device 10 may have housing 12. Device 10 may include one or more antennas for handling wireless communications. Embodiments of device 10 that contain two antennas are sometimes described herein as an example.

Device 10 may handle communications over multiple communications bands. For example, wireless communications circuitry in device 10 may be used to handle cellular telephone communications in one or more frequency bands and data communications in one or more communications bands. With one suitable arrangement, which is sometimes described herein as an example, the wireless communications circuitry of device 10 uses a first antenna that is configured to handle communications in at least first and second communications bands and uses a second antenna that is configured to handle communications in at least a third communications band. The first antenna may, for example, handle communications in a communications band that is centered at 2.4 GHz (e.g., WiFi and/or Bluetooth frequencies) while simultaneously receiving Global Positioning Systems (GPS) communications at 1575 MHz. The second antenna may handle cellular telephone communications bands and/or 3G data communications bands such as the Universal Mobile Telecommunications System (UMTS) 3G data communications band at 2170 MHz (as examples).

Housing 12, which is sometimes referred to as a case, may be formed of any suitable materials including plastic, glass, ceramics, metal, other suitable materials, or a combination of these materials. In some situations, housing 12 or portions of housing 12 may be formed from a dielectric or other low-conductivity material, so that the operation of conductive antenna elements that are located in proximity to housing 12 is not disrupted. Housing 12 or portions of housing 12 may also be formed from conductive materials such as metal.

An illustrative housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 may be shorted to an internal ground plane in device 10 to create a larger ground plane element for that device 10. To facilitate electrical contact between an anodized aluminum housing and other metal components in device 10, portions of the anodized surface layer of the anodized aluminum housing may be selectively removed during the manufacturing process (e.g., by laser etching).

Housing 12 may have a bezel 14. The bezel 14 may be formed from a conductive material. The conductive material may be a metal (e.g., an elemental metal or an alloy) or other suitable conductive materials. With one suitable arrangement, which is sometimes described herein as an example, bezel 14 may be formed from stainless steel. Stainless steel can be manufactured so that it has an attractive shiny appearance, is structurally strong, and does not corrode easily. If desired, other structures may be used to form bezel 14. For example, bezel 14 may be formed from plastic that is coated with a shiny coating of metal or other suitable substances.

Bezel 14 may serve to hold a display or other device with a planar surface in place on device 10. As shown in FIG. 1, for example, bezel 14 may be used to hold display 16 in place by attaching display 16 to housing 12. Device 10 may have front and rear planar surfaces. In the example of FIG. 1, display 16 is shown as being formed as part of the planar front surface of device 10. The periphery of the front surface may be surrounded by bezel 14. If desired, the periphery of the rear surface may be surrounded by a bezel (e.g., in a device with both front and rear displays).

Display 16 may be a liquid crystal diode (LCD) display, an organic light emitting diode (OLED) display, or any other suitable display. The outermost surface of display 16 may be formed from one or more plastic or glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter.

In a typical arrangement, bezel 14 may have prongs that are used to secure bezel 14 to housing 12 and that are used to electrically connect bezel 14 to housing 12 and other conductive elements in device 10. The housing and other conductive elements form a ground plane for the antenna(s) in the handheld electronic device. A gasket (e.g., an o-ring formed from silicone or other compliant material, a polyester film gasket, etc.) may be placed between the underside of bezel 14 and the outermost surface of display 16. The gasket may help to relieve pressure from localized pressure points that might otherwise place stress on the glass or plastic cover of display 16. The gasket may also help to visually hide portions of the interior of device 10 and may help to prevent debris from entering device 10.

In addition to serving as a retaining structure for display 16, bezel 14 may serve as a rigid frame for device 10. In this capacity, bezel 14 may enhance the structural integrity of device 10. For example, bezel 14 may make device 10 more rigid along its length than would be possible if no bezel were used. Bezel 14 may also be used to improve the appearance of device 10. In configurations such as the one shown in FIG. 1 in which bezel 14 is formed around the periphery of a surface of device 10 (e.g., the periphery of the front face of device 10), bezel 14 may help to prevent damage to display 16 (e.g., by shielding display 16 from impact in the event that device 10 is dropped, etc.).

Display screen 16 (e.g., a touch screen) is merely one example of an input-output device that may be used with handheld electronic device 10. If desired, handheld electronic device 10 may have other input-output devices. For example, handheld electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 24 and 22 may, if desired, form microphone and speaker ports. Display screen 16 may be, for example, a liquid crystal display (LCD), an organic light-emitting diode (OLED) display, a plasma display, or multiple displays that use one or more different display technologies. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface devices such as button 19 and touch screen 16. Suitable user input interface devices for handheld electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown as being formed on the top face of handheld electronic device 10 in the example of FIG. 1, buttons such as button 19 and other user input interface devices may generally be formed on any suitable portion of handheld electronic device 10. For example, a button such as button 19 or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as port 20. Port 20, which may sometimes be referred to as a dock connector, 30-pin data port connector, input-output port, or bus connector, may be used as an input-output port (e.g., when connecting device 10 to a mating dock connected to a computer or other electronic device). Device 10 may also have audio and video jacks that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, a subscriber identity module (SIM) card port to authorize cellular telephone service, a memory card slot, etc. The functions of some or all of these devices and the internal circuitry of handheld electronic device 10 can be controlled using input interface devices such as touch screen display 16.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of handheld electronic device 10 to function properly without being disrupted by the electronic components.

With one suitable arrangement, which is sometimes described herein as an example, handheld electronic device 10 has two antennas. A first antenna may be located in the upper end of device 10 in region 21. A second antenna may be located in the lower end of device 10 in region 18.

The first antenna may be (for example), a multiband antenna that covers two or more frequency bands of interest such as the WiFi/Bluetooth band at 2.4 GHz and the GPS band at 1575 MHz. The second antenna may be used to cover bands such as cellular telephone bands, data bands (e.g., 3G data bands), etc. An advantage of locating the first and second antennas at opposite ends of device 10 is that this separates the antennas from each other and helps to reduce the possibility of radio-frequency interference.

Figure 2:
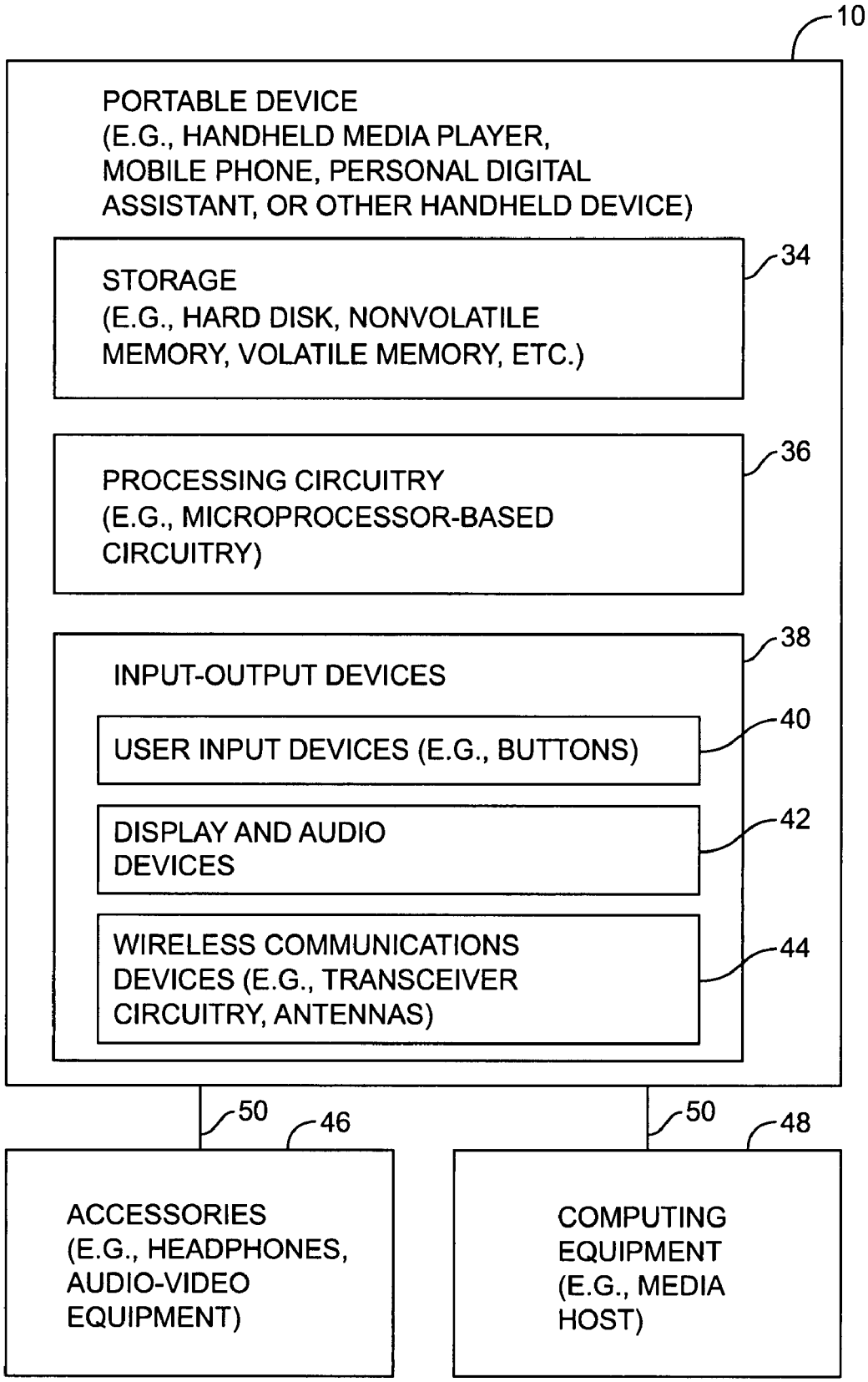
FIG. 2 is a schematic diagram of an illustrative handheld electronic device with antenna structures in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VoIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as WiFi®), protocols for other short-range wireless communications links such as the Bluetooth® protocol, protocols for handling 3G data services such as UMTS, Global Positioning System (GPS) protocols, cellular telephone communications protocols, etc.

Input-output devices 38 may be used to allow data to be supplied to device 10 and to allow data to be provided from device 10 to external devices. Display screen 16, button 19, microphone port 24, speaker port 22, and dock connector port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2170 MHz (commonly referred to as the UMTS or Universal Mobile Telecommunications System band), the WiFi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1575 MHz. The 850 MHz band is sometimes referred to as the Global System for Mobile (GSM) communications band. The 900 MHz communications band is sometimes referred to as the Extended GSM (EGSM) band. The 1800 MHz band is sometimes referred to as the Digital Cellular System (DCS) band. The 1900 MHz band is sometimes referred to as the Personal Communications Service (PCS) band.

Device 10 can cover these communications bands and/or other suitable communications bands with proper configuration of the antenna structures in wireless communications circuitry 44.

Figure 3:
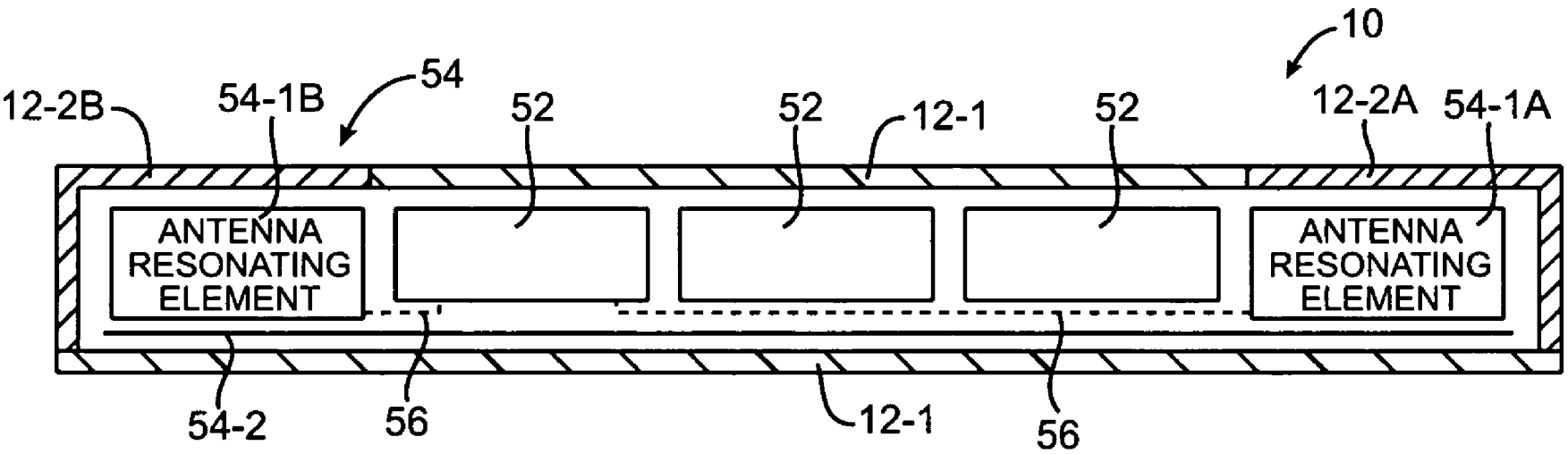
FIG. 3 is a cross-sectional side view of an illustrative handheld electronic device with a multiband antenna and an additional antenna in accordance with an embodiment of the present invention.

A cross-sectional view of an illustrative handheld electronic device is shown in FIG. 3. In the example of FIG. 3, device 10 has a housing that is formed of a conductive portion 12-1 and dielectric portions 12-2A and 12-2B (e.g., portions 12-2A and 12-2B that are formed from plastic). Conductive portion 12-1 may be any suitable conductor such as aluminum, magnesium, stainless steel, alloys of these metals and other metals, etc. Conductive portion 12-1 may include a substantially rectangular conductive rear housing surface and housing side walls. Dielectric portions 12-2A and 12-2B may serve as caps that cover antennas that are mounted within housing 12. With one suitable arrangement, dielectric portions 12-2A and 12-2B may lie flush with the exterior surfaces of housing 12 (i.e., with the rear surface and sidewall surfaces of conductive housing portion 12-1).

There are two antennas in the example of FIG. 3. A first of the two antennas is formed from antenna resonating element 54-1B and antenna ground plane 54-2. Antenna ground plane 54-2 has a slot in the vicinity of resonating element 54-1B. A second of the two antennas is formed from antenna resonating element 54-1A and ground plane 54-2.

The first antenna (depicted as antenna 54 in FIG. 3) may be formed from an elongated resonating element such as an L-shaped strip or arm. The resonating element may be formed from any suitable conductive structure such as a length of wire, a strip of metal foil or other conductor, or a trace on a flex circuit. The resonating element of the first antenna may be coupled to the slot in the ground plane through near-field electromagnetic coupling. The first antenna may operate in a first (e.g., lower) frequency band (e.g., the GPS band at 1575 MHz) and a second (e.g., higher) frequency band (e.g., 2.4 GHz for Bluetooth and/or WiFi communications). In the lower frequency band, the L-shaped arm may operate as a non-radiating coupling stub that excites the slot. The antenna characteristics of the slot may be used to handle signals in the lower frequency band. The L-shaped arm may be used to handle radio-frequency communications in the higher frequency band.

An advantage of using dielectric for housing portions 12-2A and 12-2B is that this allows the antennas of device 10 to operate without interference from the metal sidewalls of housing 12. With one suitable arrangement, housing portions 12-2A and 12-2B may be plastic caps formed from a plastic based on acrylonitrile-butadiene-styrene copolymers (sometimes referred to as ABS plastic). These are merely illustrative housing materials for device 10. For example, the housing of device 10 may be formed substantially from plastic or other dielectrics, substantially from metal or other conductors, or from any other suitable materials or combinations of materials.

Components such as components 52 may be mounted on circuit boards in device 10. The circuit board structures in device 10 may be formed from any suitable materials. Suitable circuit board materials include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Circuit boards fabricated from materials such as FR-4 are commonly available, are not cost-prohibitive, and can be fabricated with multiple layers of metal (e.g., four layers). So-called flex circuits, which are flexible circuit board materials such as polyimide, may also be used in device 10.

Typical components in device 10 include integrated circuits, LCD screens, and user input interface buttons. Device 10 also typically includes a battery, which may be mounted along the rear face of housing 12 (as an example).

Because of the conductive nature of components such as these and the printed circuit boards upon which these components are mounted, the components, circuit boards, and conductive housing portions (including bezel 14) of device 10 may be grounded together to form antenna ground plane 54-2. With one illustrative arrangement, ground plane 54-2 may conform to the generally rectangular shape of housing 12 and device 10 and may match the rectangular lateral dimensions of housing 12.

Ground plane element 54-2 and antenna resonating element 54-1B may form first antenna 54 for device 10. Optional additional antennas such as the antenna formed from antenna resonating element 54-1A and ground plane 54-2 may, if desired, be configured to provide additional gain for an overlapping frequency band of interest (i.e., a band at which antenna 54 is operating) or may be used to provide coverage in a different frequency band of interest (i.e., a band outside of the range of antenna 54).

Any suitable conductive materials may be used to form ground plane element 54-2 and resonating elements 54-1A and 54-1B. Examples of suitable conductive materials for the antenna structures in device 10 include elemental metals, such as copper, silver, and gold, and metal alloys (e.g., beryllium copper). Conductors other than metals may also be used, if desired. With one suitable scenario, the conductive structures for resonating element 54-1A may be formed from copper traces on a flex circuit or other suitable substrate and the conductive structures for resonating element 54-1B may be formed from a strip of beryllium copper foil.

Components 52 may include transceiver circuitry (see, e.g., devices 44 of FIG. 2). The transceiver circuitry may be provided in the form of one or more integrated circuits and associated discrete components (e.g., filtering components). The transceiver circuitry may include one or more transmitter integrated circuits, one or more receiver integrated circuits, switching circuitry, amplifiers, etc. Each transceiver in the transceiver circuitry may have an associated coaxial cable, microstrip transmission line, or other transmission line that is connected to an associated antenna and over which radio frequency signals are conveyed. In the example of FIG. 3, transmission lines are depicted by dashed line 56.

Transmission lines 56 may be used to distribute radio-frequency signals that are to be transmitted through the antennas from a transmitter integrated circuit 52. Paths 56 may also be used to convey radio-frequency signals that have been received by an antenna to components 52. Components 52 may include one or more receiver integrated circuits for processing incoming radio-frequency signals.

As shown in the cross-sectional diagram of FIG. 3, it may be advantageous to locate the antennas in device 10 near the extremities of device 10 (e.g., at either end of device 10). If desired, the antenna formed from antenna resonating element 54-1A and ground plane 54-2 may be omitted. If this antenna is omitted from device 10, there may be additional space available for components 52 in housing 12 or the size of housing 12 may be reduced.

Part of the frequency response of antenna 54 may be obtained by forming an opening within ground plane 54-2 that resonates in a desired frequency band (e.g., the lower frequency band in a two-band arrangement). The opening, which is sometimes referred to as a slot, may have any suitable shape. For example, the slot may be rectangular, the slot may have curved sides, the slot may have any suitable number of straight sides, the slot may have a combination of straight sides and curved sides, etc.

In operation, the portion of antenna 54 that contains the slot forms a slot antenna. The slot antenna structure in antenna 54 can be used at the same time as a resonating element arm (e.g., an L-shaped strip). In particular, antenna performance can be improved when operating antenna 54 as a hybrid device in which both its L-shaped arm operating characteristics and its slot antenna operating characteristics are present. In hybrid operation, the slot antenna portion of the antenna may provide a frequency response in a lower frequency communications band, whereas the L-shaped arm portion of the antenna may provide a frequency response in a higher frequency communications band.

Figure 4:
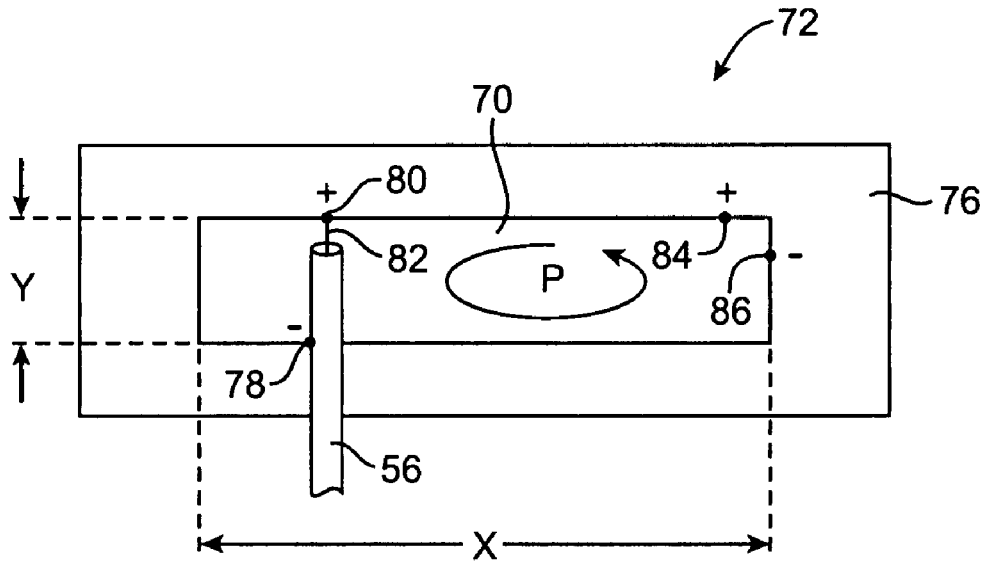
FIG. 4 is a top view of an illustrative slot antenna in accordance with an embodiment of the present invention.

A top view of an illustrative slot antenna is shown in FIG. 4. Antenna 72 of FIG. 4 is typically thin in the dimension into the page (i.e., antenna 72 is planar with its plane lying in the page). Slot 70 may be formed in the center of antenna 72. Slot 70 of FIG. 4 is shown as being rectangular in shape as an example, but in general, slot 70 may have any suitable shape.

Coaxial cable 56 or other transmission line path may be used to feed antenna 72. In the example of FIG. 4, antenna 72 is fed so that center conductor 82 of coaxial cable 56 is connected to signal terminal 80 (i.e., the positive or feed terminal of antenna 72) and the outer braid of coaxial cable 56, which forms the ground conductor for cable 56, is connected to ground terminal 78.

Figure 5:
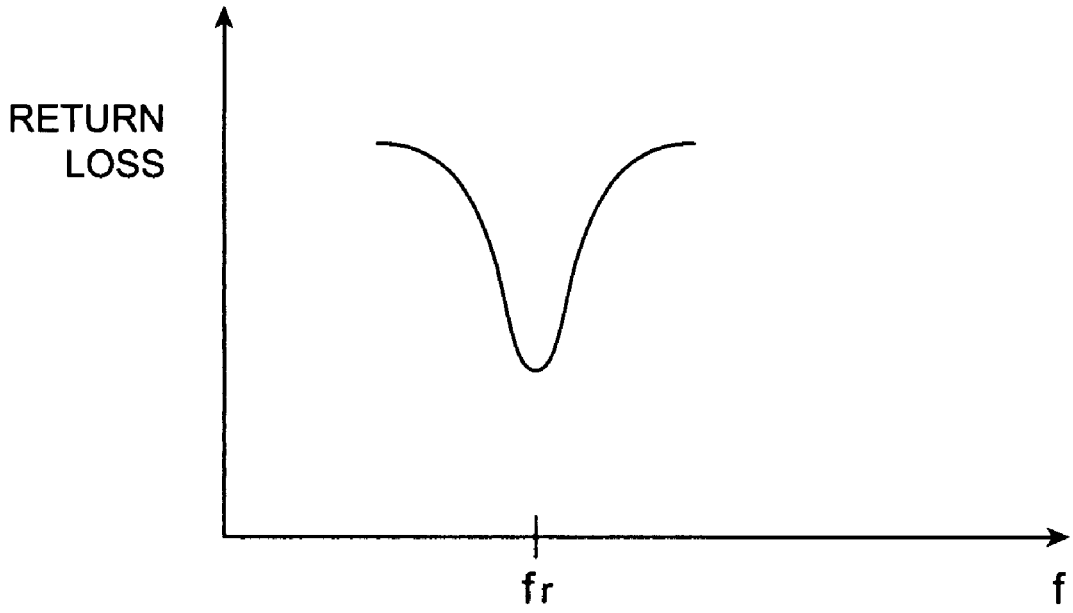
FIG. 5 is an illustrative antenna performance graph for an antenna of the type shown in FIG. 4 in which return loss values are plotted as a function of operating frequency in accordance with an embodiment of the present invention.

When antenna 72 is fed using the arrangement of FIG. 4, the antenna's performance is given by the graph of FIG. 5. As shown in FIG. 5, antenna 72 operates in a frequency band that is centered about center frequency $f_r$. The center frequency $f_r$ is determined by the dimensions of slot 70. Slot 70 has an inner perimeter P that is equal to two times dimension X plus two times dimension Y (i.e., P=2X+2Y). At center frequency $f_r$, perimeter P is equal to one wavelength. The position of terminals 80 and 78 may be selected for impedance matching. If desired, terminals such as terminals 84 and 86, which extend around one of the corners of slot 70 may be used to feed antenna 72, provided that the distance between terminals 84 and 86 is chosen to properly adjust the impedance of antenna 72. Optional impedance matching network components may also be used for impedance matching. In the illustrative arrangement of FIG. 4, terminals 84 and 86 are shown as being respectively configured as a slot antenna ground terminal and a slot antenna signal terminal, as an example. If desired, terminal 84 could be used as a ground terminal and terminal 86 could be used as a signal terminal. Slot 70 is typically an air-filled slot, but may, in general, be filled with any suitable dielectric.

Figure 6:
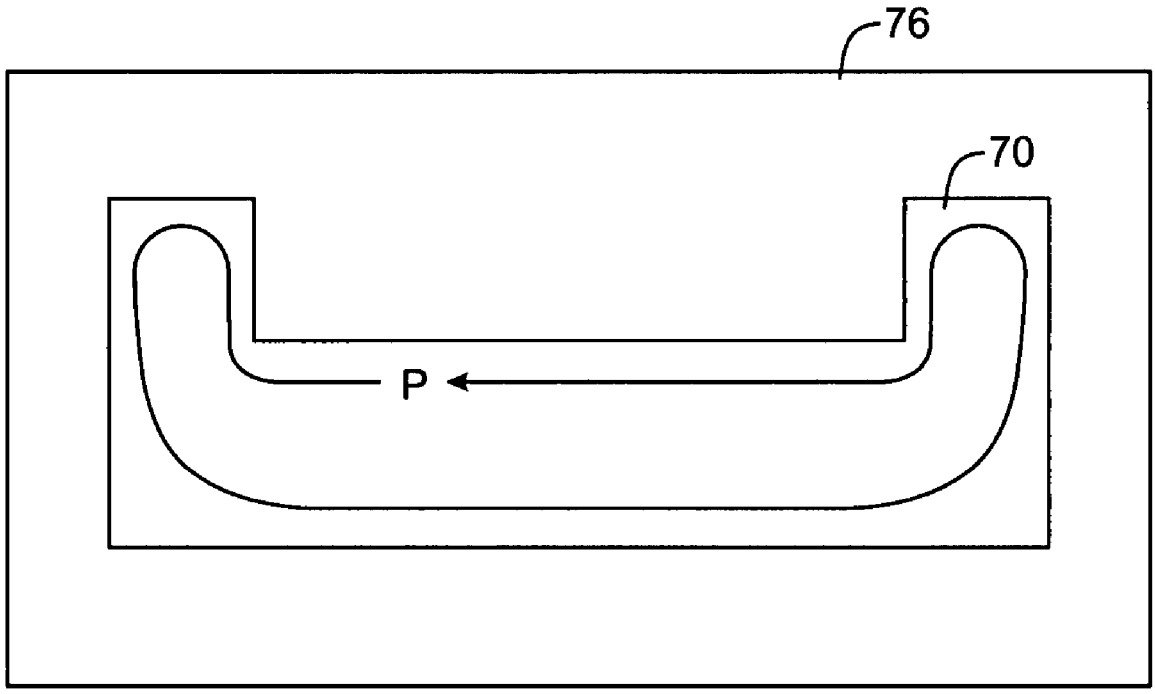
FIG. 6 is a top view of an illustrative non-rectangular slot antenna structure in accordance with an embodiment of the present invention.

An arrangement in which slot 70 has a non-rectangular shape is shown in FIG. 6.

Figure 7:
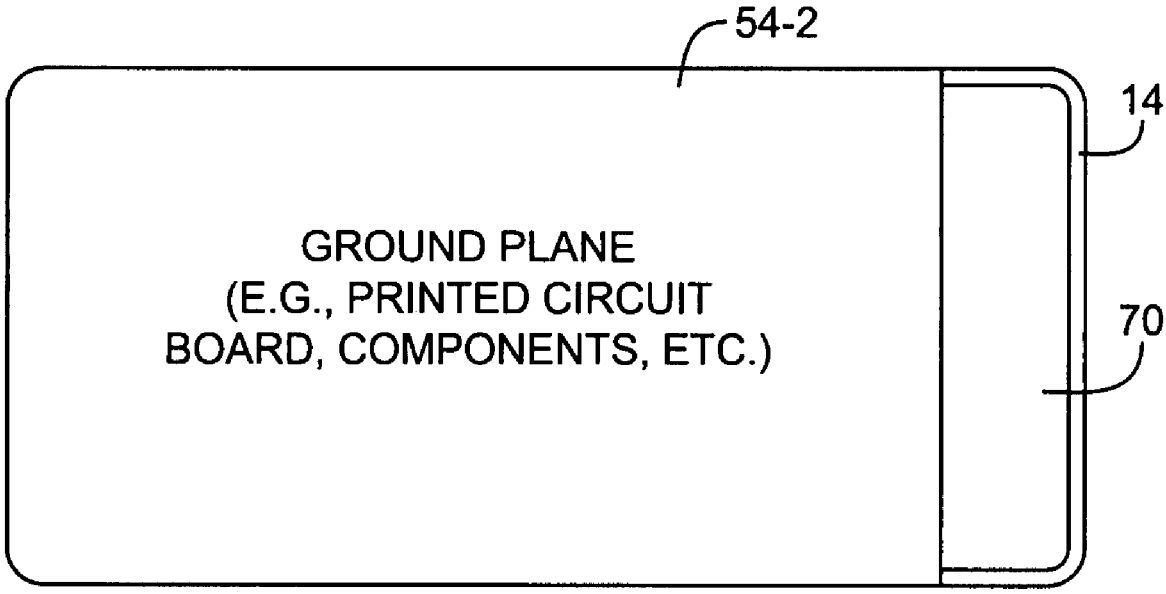
FIG. 7 is a top interior view of an illustrative handheld electronic device in which a slot antenna structure has a shape determined by the relative positions of a conductive bezel and a ground plane element in accordance with an embodiment of the present invention.

The shape of slot 70 may be defined by the shape of an opening in a printed circuit board or other mounting structure. The shape of slot 70 may also be defined by the layout of conductive components within device 10. With one suitable arrangement, the shape of slot 70 is defined by an opening that is formed by bezel 14 and the printed circuit board structures and conductive components 52 in device 10 that form ground plane 54-2. An illustrative arrangement of this type is shown in FIG. 7. In the example of FIG. 7, slot 70 has a shape that is determined by the size and shape of the opening formed between conductive bezel 14 (which may be considered to be part of ground plane 54-2) and the other portions of ground plane 54-2. Slots whose shapes are determined in this way may have any suitable shape (e.g., rectangular, irregular shapes with curved and straight sides, etc.). An advantage of using bezel 14 to form part of the sides of slot 70 and thereby determine the shape of slot 70 is that this allows a conductive bezel to be formed around the entire periphery of device 10 while locating antenna 54 near to one of the ends of device 10.

Figure 8:
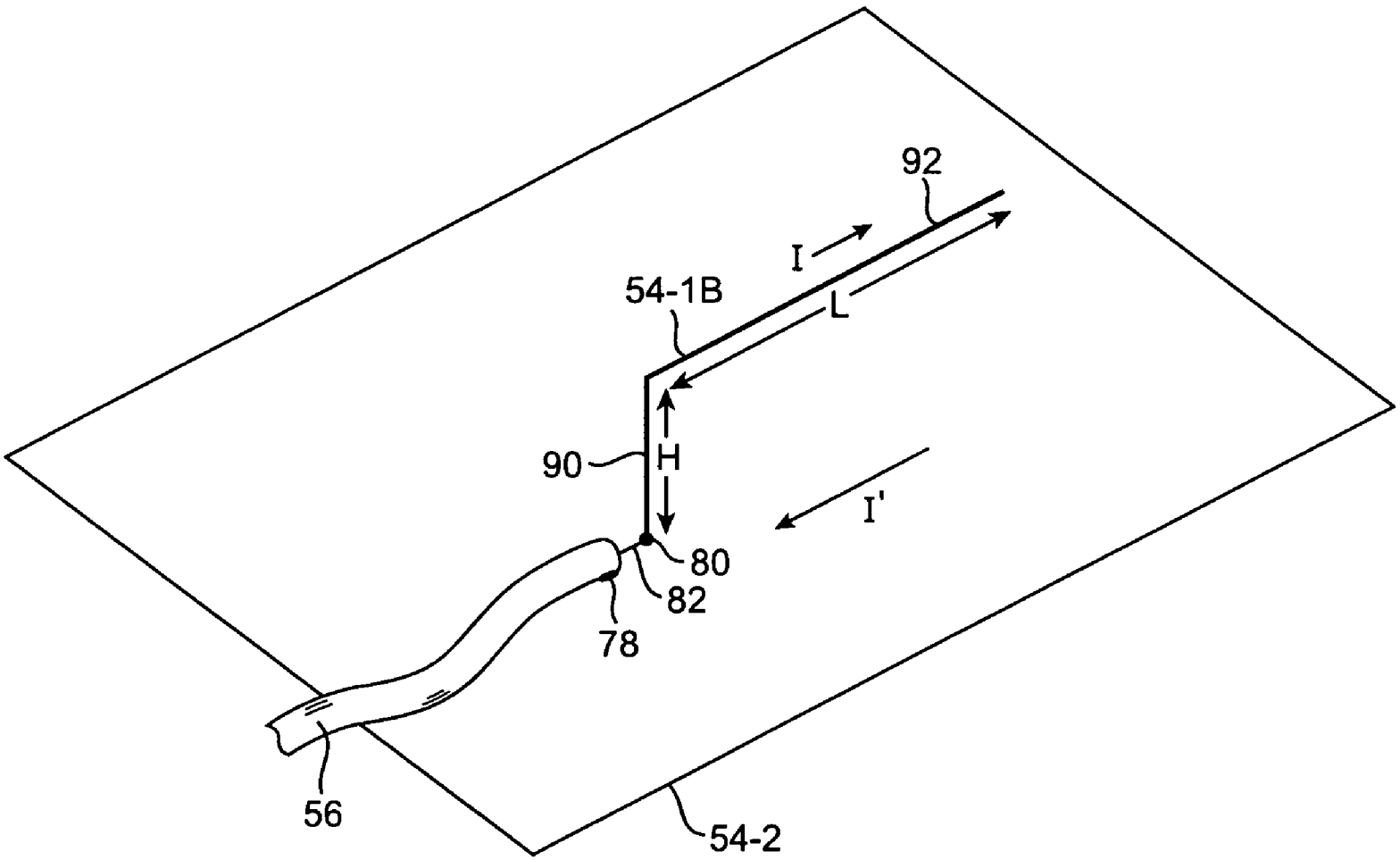
FIG. 8 is a perspective view of an illustrative antenna having an L-shaped strip resonating element in accordance with an embodiment of the present invention.

An antenna formed from ground plane 54-2 and an illustrative L-shaped antenna resonating element such as element 54-1B is shown in FIG. 8. In the arrangement of FIG. 8, the antenna is fed so that center conductor 82 of coaxial cable 56 is connected to perpendicular antenna resonating element arm portion 90 at point 80 (the positive antenna terminal) and so that the outer braid of coaxial cable 56 is connected to ground plane element 54-2 to form antenna ground terminal 78. The portion of ground plane element 54-2 that lies under element 54-1B may be formed from printed circuit board or other suitable conductive structures. Perpendicular arm portion 90 may be perpendicular to ground plane 54-2 and may extend upwards from plane 54-2 for a height H (typically at least several millimeters). Perpendicular arm portion 90 may be connected to parallel arm potion 92. Parallel arm portion 92 may extend parallel to ground plane 54-2 for a length L (typically at least several millimeters). Resonating element 54-1B need not be formed in precisely an L shape. For example, resonating element 54-1B may have curves, bends, or other features, provided that resonating element 54-1B extends away from ground plane 54-2.

During operation, a radio-frequency alternating current signal I flows from signal line 82 of transmission line 56 through resonating element 54-1B. As shown in FIG. 8, as current I flows outwards along resonating element branch 92, an opposite current I' is induced in ground plane 54-2 and flows into ground terminal 78 due to the principles of charge balance.

To extend the frequency coverage of antenna 54, the antenna may have a slot such as slot 70 of FIG. 4 that is located adjacent to a resonating element such as resonating element 54-1B of FIG. 8.

Figure 9:
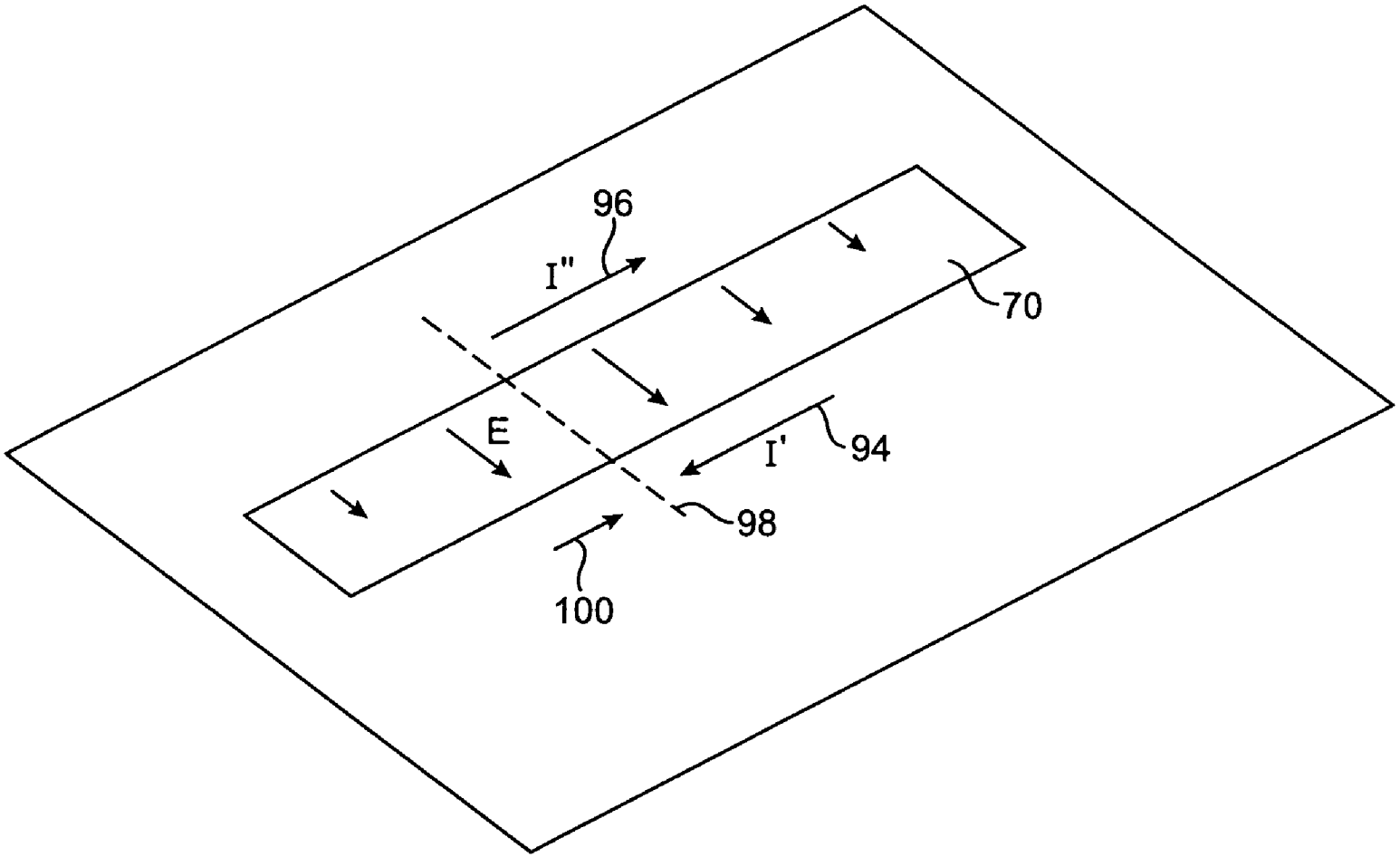
FIG. 9. is a perspective view of an antenna slot showing how current may be induced across an antenna slot through near field coupling in accordance with an embodiment of the present invention.
Figure 10:
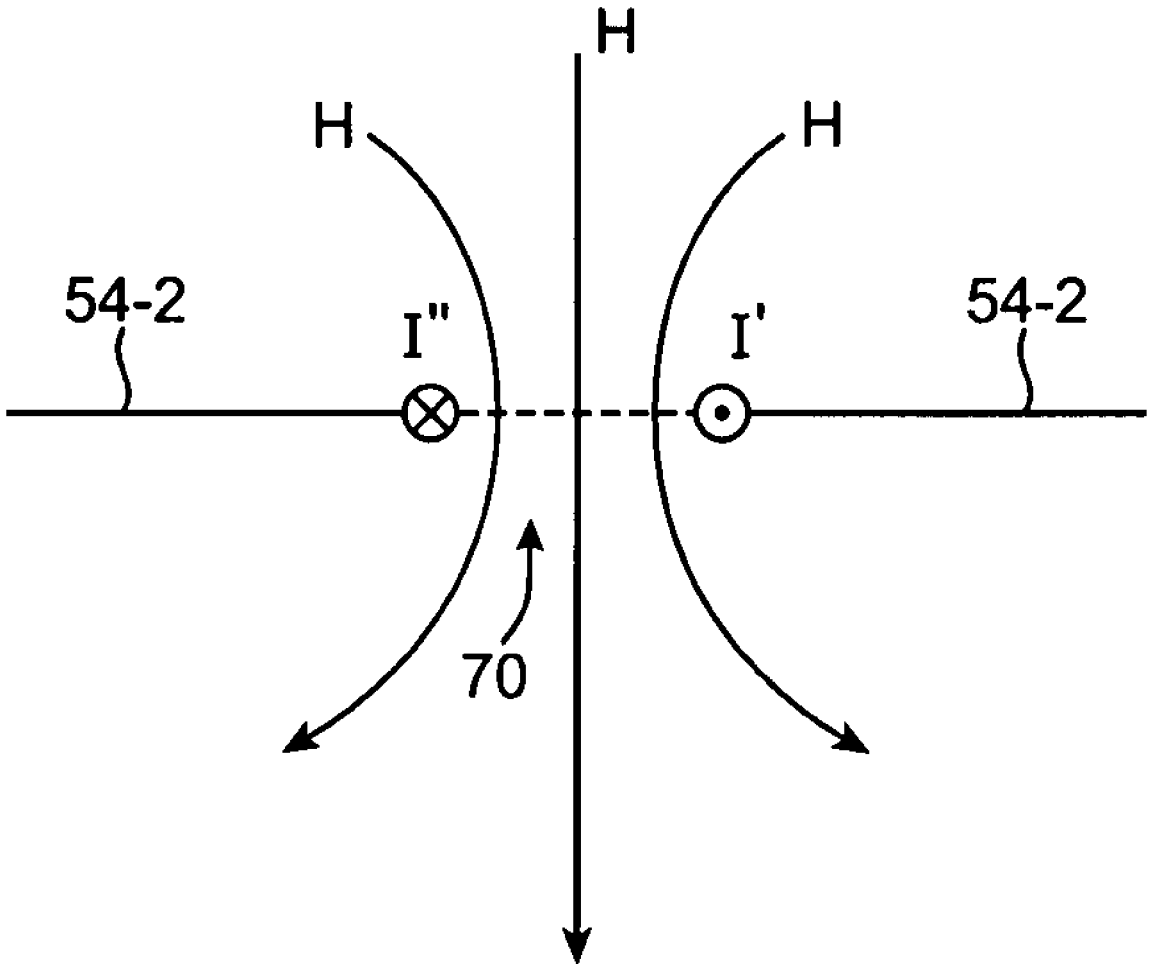
FIG. 10 is a cross-sectional view of the antenna slot of FIG. 9 taken along the dashed line of FIG. 9 in accordance with an embodiment of the present invention.

As shown in FIG. 9, in situations in which current I' is flowing in direction 94 adjacent to slot 70, near field electromagnetic coupling induces an opposing current I" that flows in direction 96 on the opposite side of the slot. In this situation, an electric field E is produced across slot 70. A cross-sectional view of slot 70 taken along line 98 when viewed in direction 100 is shown in FIG. 10. The cross-sectional view of FIG. 10 shows the magnetic field lines H that are produced by the currents of FIG. 9.

As illustrated by the flow of currents I, I', and I" of FIGS. 8, 9, and 10, near field coupling allows a resonating element such as resonating element 54-1B of FIG. 8 to excite an antenna slot such as slot 70 of FIGS. 9 and 10. Through this mechanism, a hybrid antenna 54 may be formed that exhibits a multiband frequency response. Low-band coverage can be produced by resonances associated with slot 70, whereas high-band coverage can be produced by resonances associated with arm 54-1B. Alternatively, through use of a sufficiently long arm 54-1B and a slot with a sufficiently small inner perimeter, high-band coverage can be produced by resonances associated with slot 70, while low-band coverage can be produced by resonances associated with arm 54-1B.

Figure 11:
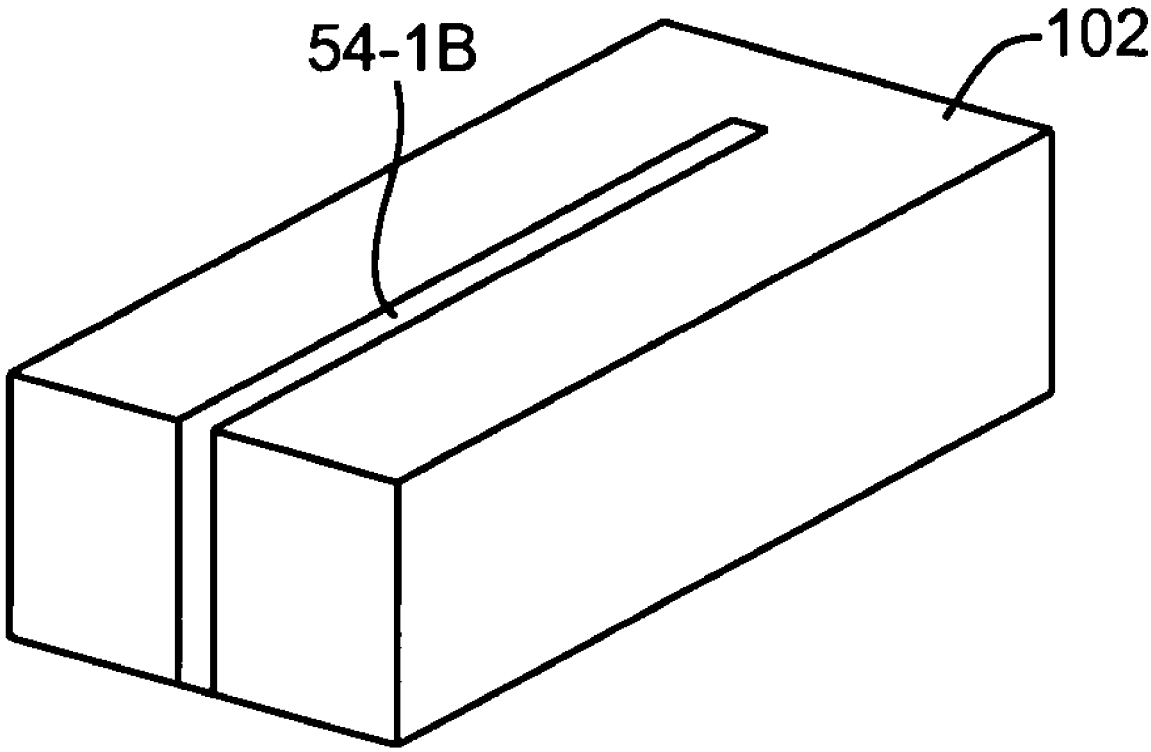
FIG. 11 is a perspective view of an illustrative antenna resonating element support structure that may be used to support a strip antenna resonating element in accordance with an embodiment of the present invention.

If desired, resonating element 54-1B may be supported by a support structure such as support structure 102 of FIG. 11. Support structure 102 may be formed from plastic or other suitable dielectric to avoid interfering with the operation of antenna 54. Although resonating element 54-1B of FIG. 11 has a generally L-shaped appearance, resonating element 54-1B may be formed from a strip of conductor (e.g., a trace, stamped foil line, etc.) having bends, curves, or other suitable shapes. The thickness (smallest lateral dimension) of the conductor that is used to form resonating element 54-1B may be, for example, 0.05 mm to 1 mm. The width (the second smallest lateral dimension) of the strip of conductor may be, for example, 0.1 mm to 5 mm or 0.5 mm to 1 mm. The length of the strip of conductor may be, for example, 5 mm to 30 mm. As shown by these examples, the lateral dimensions of the strip antenna resonating element (i.e., the dimensions of the conductive strip that are perpendicular to its longitudinal axis) are typically less than 1 mm. If desired, a wire may be used to form resonating element 54-1B (e.g., a wire with a diameter of less than 1 mm or a wire with other suitable compact lateral dimensions perpendicular to its longitudinal axis of less than 1 mm).

Figure 12:
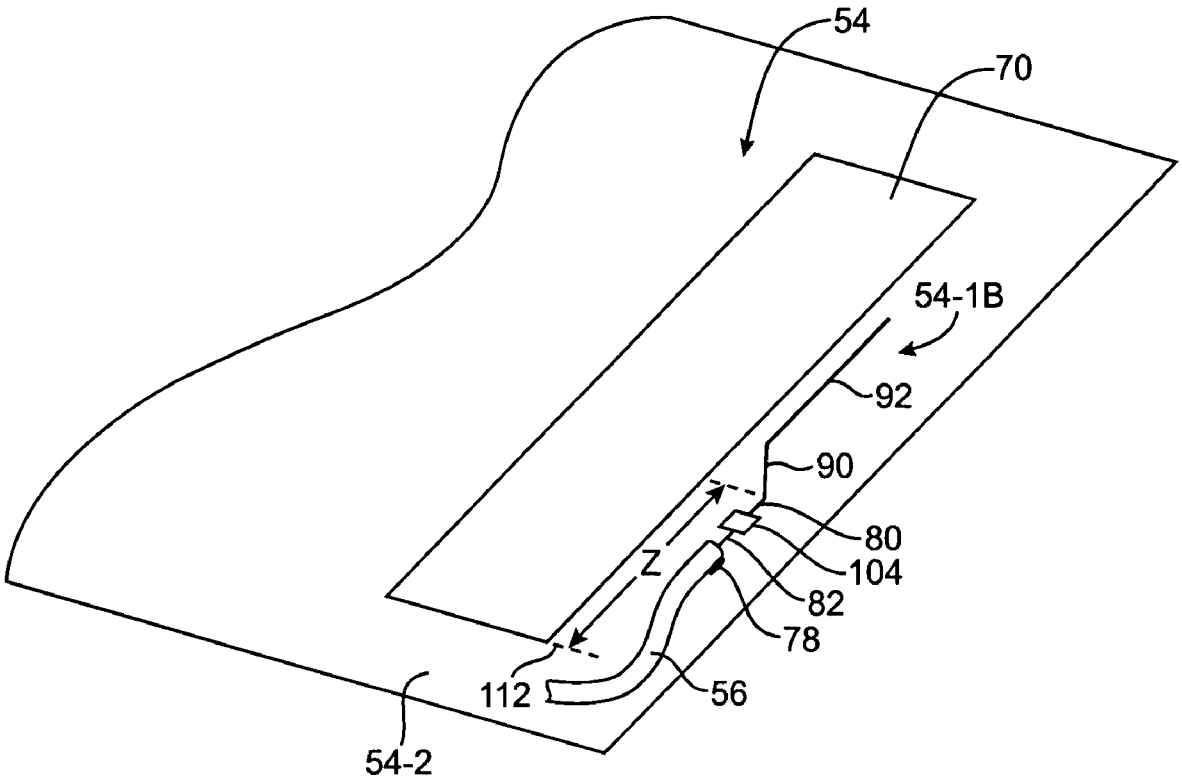
FIG. 12 is a perspective view of an illustrative antenna in accordance with an embodiment of the present invention.

An illustrative hybrid antenna that is formed from an antenna slot and a near-field-coupled strip antenna resonating element is shown in FIG. 12. As shown in FIG. 12, antenna 54 may have a first portion formed from slot 70 and a second portion formed from resonating element 54-1B. Slot 70 may have a shorter lateral dimension (e.g., a width) and a longer lateral dimension (e.g., a length). An optional impedance matching network 104 may be interposed in the path between transmission line 56 and antenna resonating element 54-1B. In this path, a circuit board ground conductor (e.g., a conductor associated with a layer of a printed circuit board in ground plane 54-2) may serve as ground.

Impedance matching network 104 may be used to ensure adequate impedance matching between transmission line 56 (and the transceiver circuits that are connected to transmission line 56) and antenna 54. Any suitable circuitry may be used for impedance matching network 104. Illustrative examples of suitable impedance matching networks are shown in FIGS. 13, 14, 15, and 16.

Figure 13:
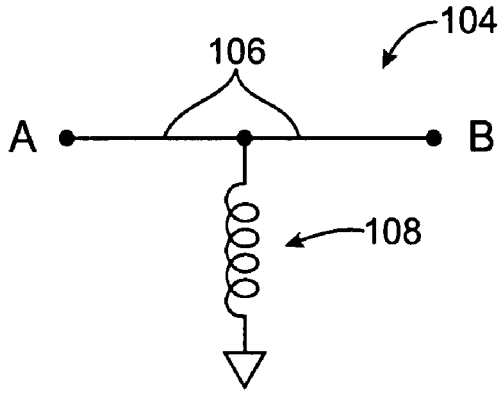
FIGS. 13, 14, 15, and 16 are circuit diagrams of illustrative antenna impedance matching networks that may be used for an antenna in a handheld electronic device in accordance with embodiments of the present invention.
Figure 14:
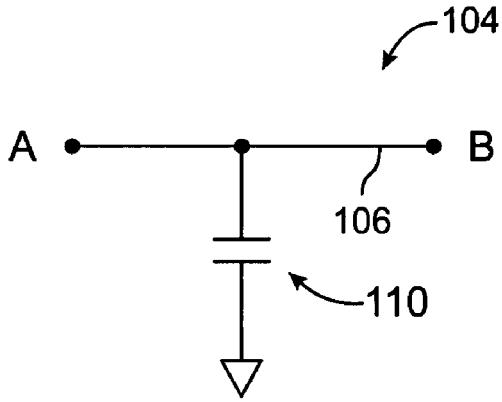
Figure 15:
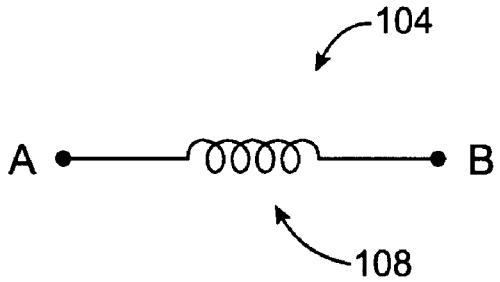
Figure 16:
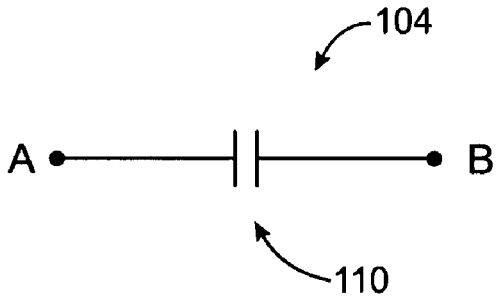

In the examples of FIGS. 13, 14, 15, and 16, terminal A is connected to the signal (center) connector of transmission line 56 and terminal B is connected to positive antenna terminal 80. In the example of FIG. 13, path 106 is connected between terminals A and B, whereas inductor 108 is connected to ground. Impedance matching network 102 of FIG. 14 contains a path 106 between terminals A and B and contains capacitor 110, which is connected to ground. Impedance matching network 104 of FIG. 15 has inductor 108 connected in series between terminals A and B (i.e., between the signal or center conductor of transmission line 56 and positive antenna terminal 80). In the arrangement of FIG. 16, impedance matching network 104 contains capacitor 110 in series in the path between terminals A and B. If desired, impedance matching network 104 may be omitted or combinations of the impedance matching networks of FIGS. 13, 14, 15, and 16 may be used. As shown in FIG. 12, the lateral distance Z between antenna positive terminal 80 and slot end 112 can also be selected to ensure proper impedance matching.

Figure 17:
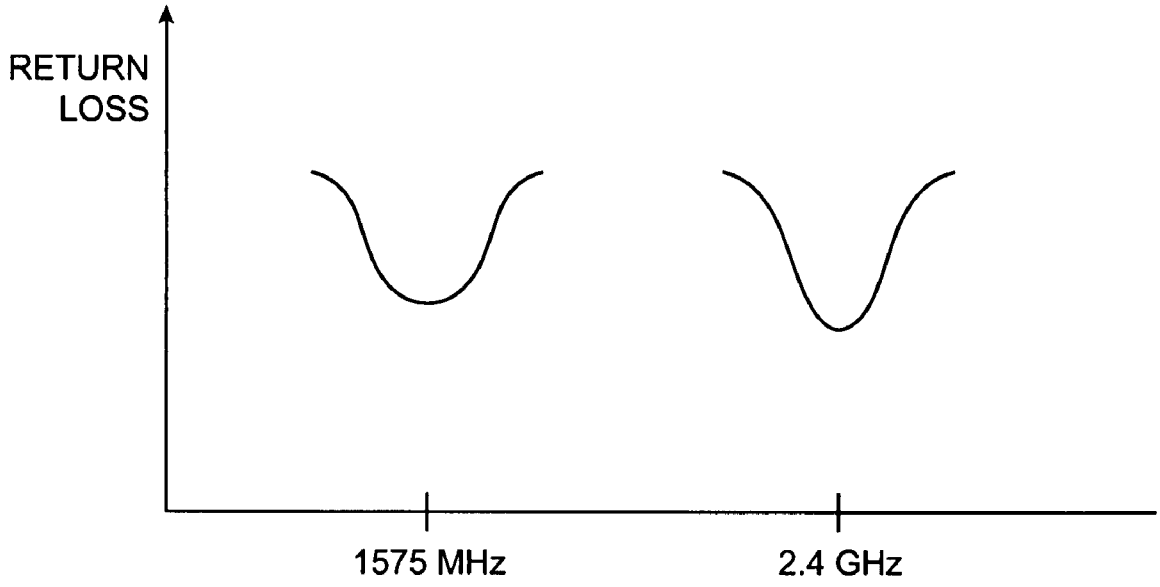
FIG. 17 is an illustrative antenna performance graph for an antenna of the type shown in FIG. 12 in which return loss values are plotted as a function of operating frequency in accordance with an embodiment of the present invention.

A graph of the expected performance of a hybrid antenna of the type represented by illustrative antenna 54 of FIG. 12 is shown in FIG. 17. Expected return loss values are plotted as a function of frequency. As shown in the graph, antenna 54 may have antenna resonances associated with multiple communications bands. In the example of FIG. 17, antenna 54 has performance peaks that coincide with two communications bands of interest. A first or lower frequency communications band is centered about the GPS frequency of 1575 MHz. A second or higher frequency communications band is centered about the Bluetooth/WiFi band of 2.4 GHz.

In the first communications band (e.g., the GPS communications band at 1575 MHz), resonating element 54-1B acts as a non-radiating coupling stub that excites slot 70. There is near-field electromagnetic coupling between resonating element 54-1B and slot 70, but resonating element 54-1B does not radiate in the first band. Slot 70 is therefore the primary contributor to the antenna performance peak in the first communications band. Resonating element 54-1B serves merely to couple signals into and out of the slot portion of the antenna at frequencies in the first communications band. In applications such as GPS applications, it is only necessary to receive signals with antenna 54, so the slot portion of the antenna can be used to receive signals in the first communications band.

The dimensions of the slot can be selected to adjust the antenna response in the first communications band. In general, wide slots tend to increase antenna bandwidth. Typical slot widths may be on the order of 1 mm to 5 mm or 1 mm to 1 cm. The inner perimeter P of the slot may be adjusted to be equal to about one wavelength at the frequency of interest.

In the second communications band (e.g., at 2.4 GHz, or, more specifically, the 2400 to 2484 MHz band), the resonating element 54-1B acts as a radiating monopole antenna. The resonating element portion of antenna 54 may therefore be used to handle transmitted and received radio-frequency signals in the second communications band. The position of the frequency resonance for the second communications band may be adjusted by adjusting the length of resonating element 54-1B (e.g., to be equal to approximately one quarter of a wavelength at the frequency of interest).

Although the illustrative antenna of FIG. 12 handles two communications bands, more bands may be covered if desired (e.g., by adding additional resonating element structures or slots, by broadening the bandwidth covered by the resonating element and/or the slot portions of the antenna to cover multiple bands, etc.). Moreover, the sizes of the slot and resonating element can be changed so that, for example, the slot portion of the antenna covers the higher frequency band, whereas the L-shaped monopole resonating element covers the lower frequency band of interest. In general, the length of the inner slot perimeter should be tuned to about one wavelength at a frequency of interest and the length of the L-shaped resonating element should be tuned to about one quarter of a wavelength at a desired operating frequency. If dielectrics other than air are placed in close proximity to the slot and/or the monopole resonating element, the wavelength of the radio-frequency signals will be affected. When the dielectric constant of a material that is adjacent to the antenna is increased, the size of perimeter P and the resonating element length may be decreased while maintaining resonance at a given desired operating wavelength.

Figure 18:
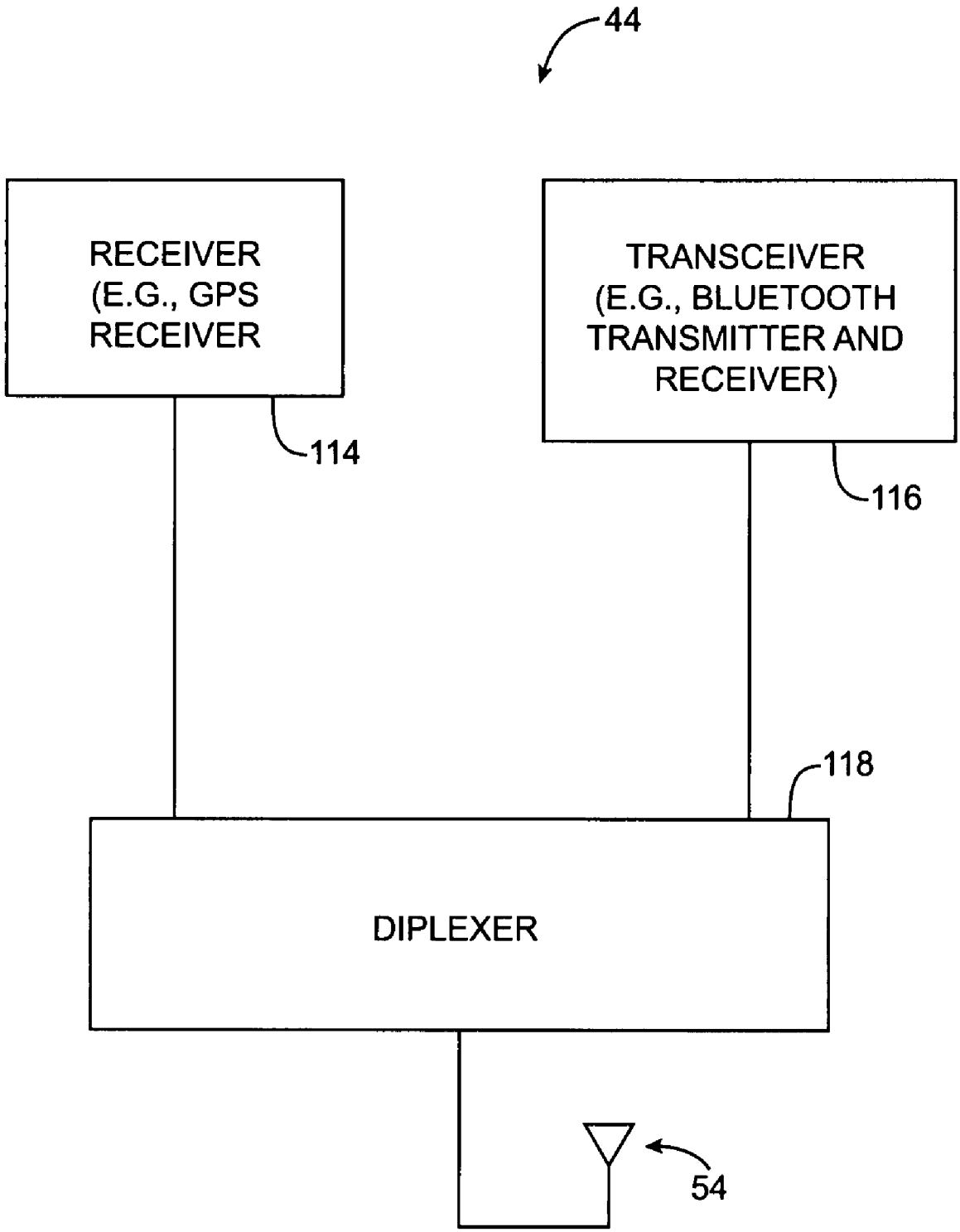
FIG. 18 is a circuit diagram showing how signals may be routed to and from an illustrative antenna in accordance with an embodiment of the present invention.
Figure 19:
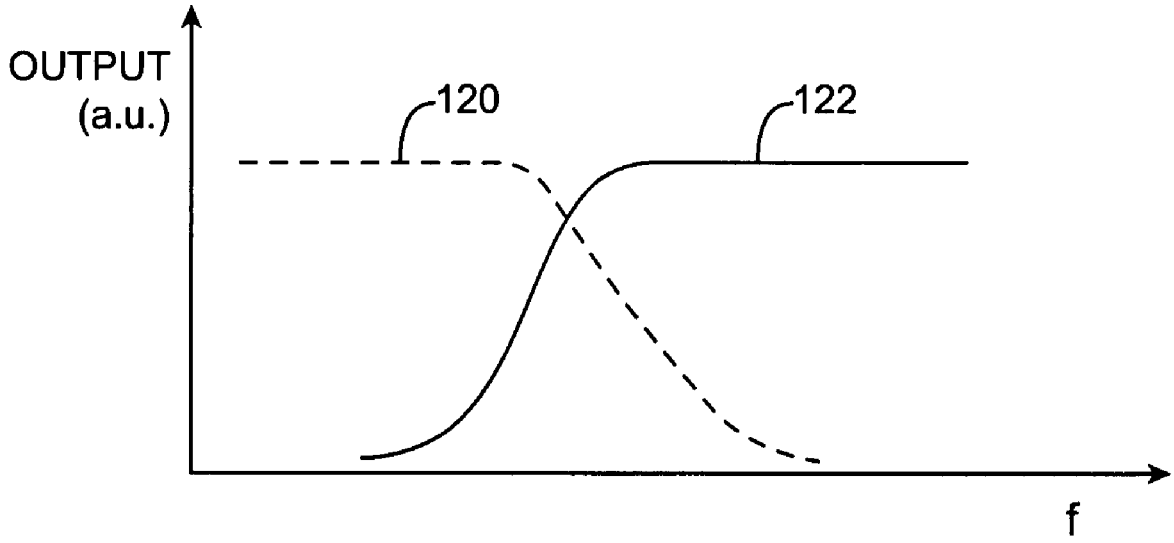
FIG. 19 is a graph showing the frequency response of an illustrative diplexer in a circuit configuration of the type shown in FIG. 18 in accordance with an embodiment of the present invention.

FIG. 18 is a circuit diagram showing how transceiver components in device 10 may be interconnected with antenna 54. As shown in FIG. 18, wireless communications circuitry 44 may include a receiver such as receiver 114 and a transceiver such as transceiver 116. Receiver 114 may be, for example, a GPS receiver that receives and processes GPS signals at 1575 MHz. Transceiver 116 may be, for example, one or more transceiver integrated circuits for handling Bluetooth and/or WiFi signals at 2.4 GHz. Diplexer 118 routes incoming signals from antenna 54 to receiver 114 and transceiver 116 depending on their frequency. An illustrative frequency response graph for diplexer 118 is shown in FIG. 19. In the example of FIG. 19, dashed line 120 represents the transmission characteristic for diplexer 118 when routing signals from antenna 54 to receiver 114 and solid line 122 represents the transmission characteristic for diplexer 118 when routing signals from antenna 54 to transceiver 116. Diplexer 118 is bidirectional, so outgoing signals from transceiver 116 are routed through diplexer 118 to antenna 54. Receiver 114 does not transmit signals, so, in the example of FIG. 18, diplexer 118 does not need to handle outgoing signals from receiver 114.

The example of FIG. 18 in which a receiver and a transceiver are connected to antenna 54 is merely illustrative. In general, multiple receivers, multiple transmitters, or multiple bidirectional transceiver circuits may be coupled to antenna 54 through a diplexer such as diplexer 118 or other suitable filter and multiplexing circuitry. The use of a diplexer for antenna coupling circuitry in wireless communications circuitry 44 of FIG. 18 is presented as an example.

The foregoing is merely illustrative of the principles of this invention and various modifications can be made by those skilled in the art without departing from the scope and spirit of the invention.

What is claimed is:

1. A handheld electronic device antenna that operates in at least a first communications band and a second communications band, comprising:

a ground plane antenna element having portions defining an antenna slot; and an antenna resonating element formed from a length of conductor, wherein:

at signal frequencies in the first communications band, the antenna resonating element serves as a non-radiating coupling stub that excites the antenna slot, and at signal frequencies in the second communications band, the antenna resonating element serves as a radiating monopole antenna.

2. The handheld electronic device antenna defined in claim 1 wherein the antenna resonating element comprises an L-shaped conductor having a first portion that extends perpendicular to the ground plane antenna element and having a second portion that extends parallel to the ground plane antenna element.

3. The handheld electronic device antenna defined in claim 1 wherein the ground plane antenna element comprises a conductive bezel.

4. The handheld electronic device antenna defined in claim 1 wherein the ground plane antenna element comprises:

a handheld electronic device housing;

a display; and a conductive bezel that mounts the display to the housing, wherein the antenna slot has a shape that is defined at least partly by the conductive bezel and other portions of the ground plane antenna element.

5. The handheld electronic device antenna defined in claim 1 wherein the ground plane antenna element comprises at least one portion that defines a straight side for the antenna slot.

6. The handheld electronic device antenna defined in claim 1 wherein the antenna slot has at least one substantially straight side and wherein the antenna resonating element comprises a portion that extends parallel to the straight side.

7. The handheld electronic device antenna defined in claim 1 wherein the antenna slot has at least one lateral dimension of 1 mm to 1 cm in length.

8. The handheld electronic device antenna defined in claim 1 wherein the antenna slot is configured to resonate at frequencies in the first communications band that are associated with global positioning system communications.

9. The handheld electronic device antenna defined in claim 1 wherein the antenna resonating element is configured to resonate at a frequency of 2.4 GHz in the second communications band.

10. The handheld electronic device antenna defined in claim 1 wherein the antenna slot is configured to resonate at frequencies in the first communications band that are associated with global positioning system communications and wherein the antenna resonating element is configured to resonate at a frequency of 2.4 GHz in the second communications band.

11. A handheld electronic device that operates in at least a first communications band and a second communications band, comprising:

a ground plane antenna element having portions defining an antenna slot;

an antenna resonating element formed from a length of conductor, wherein the ground plane element and the antenna resonating element form an antenna, wherein the antenna resonating element serves as a non-radiating coupling stub that excites the antenna slot at signal frequencies in the first communications frequency band, and wherein the antenna resonating element transmits and receives radio-frequency signals at frequencies in the second communications frequency band;

a receiver that receives radio-frequency signals from the antenna in the first communications band; and a transceiver that uses the antenna to transmit and receive radio-frequency signals in the second communications band.

12. The handheld electronic device defined in claim 11 wherein the antenna slot is configured to resonate at global positioning system frequencies within the first communications band and wherein the receiver receives signals at the global positioning system frequencies from the antenna.

13. The handheld electronic device defined in claim 11 wherein the antenna slot is configured to resonate at global positioning system frequencies within the first communications band including 1575 MHz, wherein the receiver receives signals at the global positioning system frequencies from the antenna, wherein the antenna resonating element is configured to resonate at 2.4 GHz, and wherein the transceiver transmits and receives the radio-frequency signals at 2.4 GHz using the antenna resonating element.

14. The handheld electronic device defined in claim 11 further comprising an additional antenna that transmits and receives signals in at least one communications band that is different than the first communications band and the second communications band, wherein the handheld electronic device has a first end and a second end, wherein the antenna is located at the first end of the handheld electronic device, and wherein the additional antenna is located at the second end of the handheld electronic device.

15. The handheld electronic device defined in claim 11 wherein the antenna slot has a shorter lateral dimension and a longer lateral dimension and wherein the antenna resonating element is an L-shaped conductor having a portion that extends parallel to the longer lateral dimension of the antenna slot.

16. The handheld electronic device defined in claim 11 wherein the antenna resonating element comprises an L-shaped strip of conductor.

17. The handheld electronic device defined in claim 11 further comprising an additional antenna that transmits and receives signals in at least one communications band that is different than the first communications band and that is different than the second communications band, wherein the additional antenna transmits and receives cellular telephone signals, and wherein the antenna resonating element comprises an L-shaped strip of conductor.

18. Wireless communications circuitry in a handheld electronic device that operates in at least a first communications band and a second communications band, comprising:

an antenna ground plane having portions defining an antenna slot;

an antenna resonating element that is formed from a length of conductor and that has a first end and a second end, wherein the antenna ground plane and the antenna resonating element form an antenna for the handheld electronic device, wherein, at signal frequencies in the first communications band, the antenna resonating element serves as a non-radiating coupling stub that excites the antenna slot, and wherein, at signal frequencies in the second communications band, the antenna resonating element serves as a radiating antenna; and a transmission line having a signal conductor and a ground conductor, wherein the ground conductor is electrically coupled to the ground plane and wherein the signal conductor is electrically coupled to the first end of the antenna resonating element.

19. The wireless communications circuitry defined in claim 18 further comprising:

a diplexer;

a receiver that is coupled to the antenna through the diplexer, wherein the receiver operates in the first communications band; and a transceiver that is coupled to the antenna through the diplexer, wherein the transceiver operates in the second communications band.

20. The wireless communications circuitry defined in claim 18 further comprising:

a diplexer;

a receiver that is coupled to the antenna through the diplexer, wherein the receiver operates in the first communications band and wherein the first communications band includes global positioning system frequencies; and a transceiver that is coupled to the antenna through the diplexer, wherein the transceiver operates in the second communications band and wherein the second communications band covers a frequency of 2.4 GHz.

* * * * *

UNITED STATES PATENT AND TRADEMARK OFFICE

CERTIFICATE OF CORRECTION

PATENT NO. : 7,768,462 B2
APPLICATION NO. : 11/895053
DATED : August 3, 2010
INVENTOR(S) : Zhijun Zhang et al.

It is certified that error appears in the above-identified patent and that said Letters Patent is hereby corrected as shown below:

In column 2, line 46, delete "9." and insert -- 9 --, therefor.

Signed and Sealed this
Eighth Day of November, 2011

David J. Kappos

David J. Kappos
*Director of the United States Patent and Trademark Office*